US010221504B2

(12) United States Patent
Kwon et al.

(10) Patent No.: US 10,221,504 B2
(45) Date of Patent: Mar. 5, 2019

(54) APPARATUS FOR BLENDING POLYETHYLENE TEREPHTHALATE FIBER AND KAPOK FIBER USING STATIC ELECTRICITY AND METHOD FOR BLENDING POLYETHYLENE TEREPHTHALATE FIBER AND KAPOK FIBER USING IT

(71) Applicant: Hyundai Motor Company, Seoul (KR)

(72) Inventors: Oh Deok Kwon, Suwon-si (KR); Kie Youn Jeong, Hwaseong-si (KR); Seong Je Kim, Yeosu-si (KR); Bong Hyun Park, Gunpo-si (KR); Won Jin Seo, Suwon-si (KR); Dong Uk Lee, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 599 days.

(21) Appl. No.: 14/932,681

(22) Filed: Nov. 4, 2015

(65) Prior Publication Data

US 2016/0348284 A1 Dec. 1, 2016

(30) Foreign Application Priority Data

May 28, 2015 (KR) ..... 10-2015-0074615

(51) Int. Cl.
*D01G 13/00* (2006.01)

(52) U.S. Cl.
CPC ..... *D01G 13/00* (2013.01); *D10B 2331/04* (2013.01)

(58) Field of Classification Search
CPC ..... D01G 13/00
See application file for complete search history.

(56) References Cited

U.S. PATENT DOCUMENTS 3,673,781 A * 7/1972 Breitenbach ..... D01H 4/28 57/402
3,889,034 A * 6/1975 Lenards ..... D02G 3/42 118/308
4,087,888 A * 5/1978 Tanaka ..... D01G 15/82 15/301

(Continued)

FOREIGN PATENT DOCUMENTS

JP 11-12871 1/1999
JP 4549541 7/2010

(Continued)

*Primary Examiner* — Shaun R Hurley
(74) *Attorney, Agent, or Firm* — Brinks Gilson & Lione

(57) ABSTRACT

An apparatus for blending a polyethylene terephthalate (PET) and a kapok fiber using static electricity is provided, along with a method for blending the PET fiber and the kapok fiber using the apparatus. The fiber blending apparatus includes a fiber blending chamber having an inlet in which the PET fiber and the kapok fiber are introduced and an outlet from which a nonwoven fabric is discharged. A discharge plate is positioned at an upper side and a lower side based on a center line passing through the center of a cross section of the fiber blending chamber to accumulate the static electricity. The PET fiber and the kapok fiber contacting the discharge plate are electrically charged and are thus uniformly distributed and blended around the center line and stacked around an outlet.

9 Claims, 4 Drawing Sheets

(56) References Cited

U.S. PATENT DOCUMENTS

| | | | | |
|---|---|---|---|---|
| 4,535,512 | A * | 8/1985 | Glazener | D01G 19/14 19/223 |
| 4,914,787 | A | 4/1990 | Leifeld et al. | |
| 5,530,995 | A * | 7/1996 | Eichenberger | D01G 19/18 19/231 |
| 5,699,588 | A * | 12/1997 | Hsiung | B03C 3/08 19/200 |
| 6,070,302 | A * | 6/2000 | Graf | D01G 15/84 19/114 |
| 6,263,545 | B1 * | 7/2001 | Pinto | D01G 13/00 19/205 |
| 2002/0004970 | A1 * | 1/2002 | Pinto | D01G 13/00 19/105 |
| 2002/0116792 | A1 * | 8/2002 | Pinto | D01G 13/00 19/105 |
| 2004/0074053 | A1 | 4/2004 | Hlaban et al. | |
| 2015/0090658 | A1 * | 4/2015 | Branham | B01D 39/163 210/491 |

FOREIGN PATENT DOCUMENTS

| | | |
|---|---|---|
| KR | 10-0825066 | 4/2008 |
| KR | 10-1035110 | 5/2011 |
| KR | 10-2012-0048148 | 5/2012 |
| KR | 10-1280354 | 7/2013 |

* cited by examiner

APPARATUS FOR BLENDING POLYETHYLENE TEREPHTHALATE FIBER AND KAPOK FIBER USING STATIC ELECTRICITY AND METHOD FOR BLENDING POLYETHYLENE TEREPHTHALATE FIBER AND KAPOK FIBER USING IT

CROSS-REFERENCE TO RELATED APPLICATIONS

This application claims the benefit of Korean Patent Application No. 10-2015-0074615, filed on May 28, 2015, the entire contents of which are incorporated herein by reference in their entirety.

FIELD

The present disclosure relates to an apparatus for blending a polyethylene terephthalate (hereinafter, referred to as "PET") and a kapok fiber and a method for blending the PET fiber and the kapok fiber using it.

BACKGROUND

The statements in this section merely provide background information related to the present disclosure and may not constitute prior art.

In general, a dry nonwoven fabric is prepared by a blending process that blends fibers, a carding process that removes short fibers and selects and evenly arrays only long fibers, a needle punching process that combines a 2D fiber array with 3D through vertical movement of a needle plate attached with a needle, and a winding process that conveys a nonwoven fabric and winds the conveyed nonwoven fabric on a roller.

When the nonwoven fabric is prepared by blending two or more fibers, it is desired to uniformly and reproducibly blend heterogeneous fibers in a fiber blending process.

The known fiber blending process is performed by flying and blending two or more fibers in the air. Therefore, the fibers are not uniformly blended, and as a result, the quality of a completed nonwoven fabric is not consistent.

Korean Patent Registration No. 10-1280354 and Korean Patent Registration No. 10-1268925 relate to a kapok complex nonwoven fabric and a method for preparing the same. Only a blending ratio of all kapok fibers and thermoplastic polymer fibers is disclosed and a method that can uniformly blend the fibers is not presented.

SUMMARY

The present disclosure provides a fiber blending apparatus that can uniformly blend a PET fiber and a kapok fiber.

The present disclosure has been made in an effort to provide a method that can uniformly blend the PET fiber and the kapok fiber by using the fiber blending apparatus.

In one form, the present disclosure provides an apparatus for blending a PET fiber and a kapok fiber using static electricity, including: a fiber blending chamber including an inlet in which the PET fiber and the kapok fiber are introduced and an outlet from which a nonwoven fabric is discharged; and a discharge plate positioned at an upper side and a lower side based on a center line passing through the center of a cross section of the fiber blending chamber to accumulate the static electricity, wherein the PET fiber and the kapok fiber contacting the discharge plate is charged with a charge such as the discharge plate to be pushed from the discharge plate and blended around the center line and stacked around an outlet to become the nonwoven fabric.

In one form, the apparatus may further include a nonwoven fabric guard positioned around the outlet and providing a space in which the PET fiber and the kapok fiber are stacked.

In another form, the apparatus may further include a feeder positioned around the outlet and controlling the thickness of the nonwoven fabric.

In still another form, the nonwoven fabric guard may be positioned at a lower side of the fiber blending chamber, and the feeder may be positioned at an upper side of the fiber blending chamber.

In yet another form, the apparatus may further include a blower positioned around the inlet and moving the PET fiber and the kapok fiber to the outlet in the fiber blending chamber.

In still yet another form, the inlet may be formed at the lower side of the fiber blending chamber to move the wind generated by the blower from the lower side to the upper side of the fiber blending chamber.

In a further form, the apparatus may further include: a conveyance tube connected with the inlet to become a movement path of the PET fiber and the kapok fiber; and a conveyance device connected with the outlet to discharge the nonwoven fabric to the outside of the fiber blending chamber.

In another further form, the apparatus may further include a protection cover interrupting the conveyance device from the outside.

In another form, the present disclosure provides a method for blending a PET fiber and a kapok fiber using static electricity, including: 1) a step of accumulating static electricity in discharge plates positioned at upper and lower sides of a fiber blending chamber; 2) a step of introducing the PET fiber and the kapok fiber in an inlet of the fiber blending chamber; 3) a step of the PET fiber and the kapok fiber contacting the discharge plates; 4) a step in which the PET fiber and the kapok fiber are charged with a charge such as the discharge plate to be pushed from the discharge plate and blended; 5) a step in which the PET fiber and the kapok fiber are stacked in a nonwoven fabric guard positioned around an outlet of the fiber blending chamber to become the nonwoven fabric; and 6) a step of controlling the thickness of the nonwoven fabric by a feeder positioned around the outlet.

A PET fiber and a kapok fiber may be uniformly blended by using a fiber blending apparatus and a fiber blending method according to the present disclosure.

A nonwoven fabric may be acquired, in which the PET fiber and the kapok fiber are uniformly blended by using the fiber blending apparatus and the fiber blending method according to the present disclosure.

A nonwoven fabric having high reproducibility and quality can be acquired by using the fiber blending apparatus and the fiber blending method according to the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (for example, fuels derived from resources other than petroleum). As referred to herein, a hybrid vehicle is a vehicle that has two or more sources of power, for example both gasoline-powered and electric-powered vehicles.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1 schematically illustrates a fiber blending apparatus according to the present disclosure;

Figure 1:
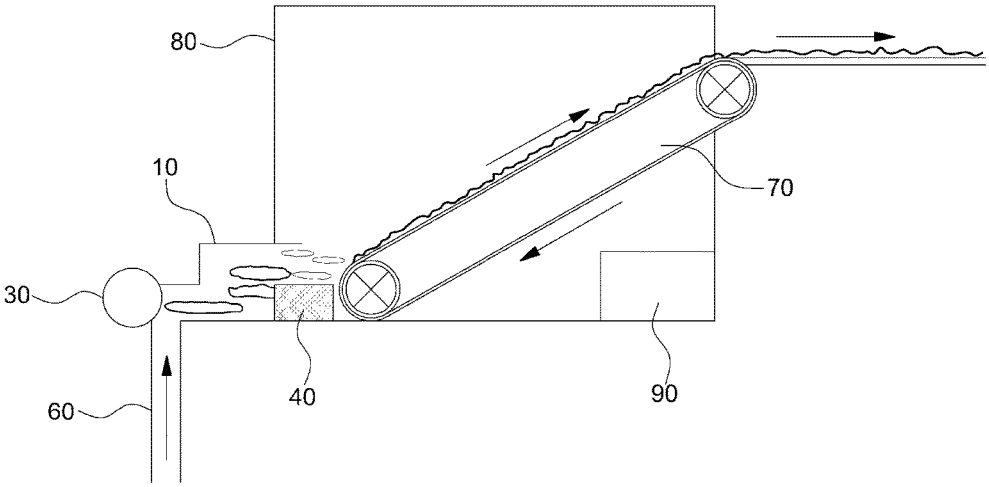

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in part by the particular intended application and use environment.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

A kapok tree is a deciduous tree that grows in Africa, Sri Lanka, Indonesia, Thailand, Vietnam, Cambodia, and the like. A kapok fiber as a seed fiber of the kapok tree has a length less than 35 mm and a diameter in the range of 10 to 50 μm and is composed of cellulose, lignin, and pentosan.

The kapok fiber is light and flexible and has sound absorption and antibacterial characteristics. Therefore, the kapok fiber is used for various purposes.

The present disclosure relates to a fiber blending apparatus that may uniformly blend a kapok fiber and a PET fiber and a fiber blending method using the same. Further, in the present disclosure, the kapok fiber and the PET fiber are stacked in the fiber blending apparatus to be prepared into a nonwoven fabric.

Figure 2:
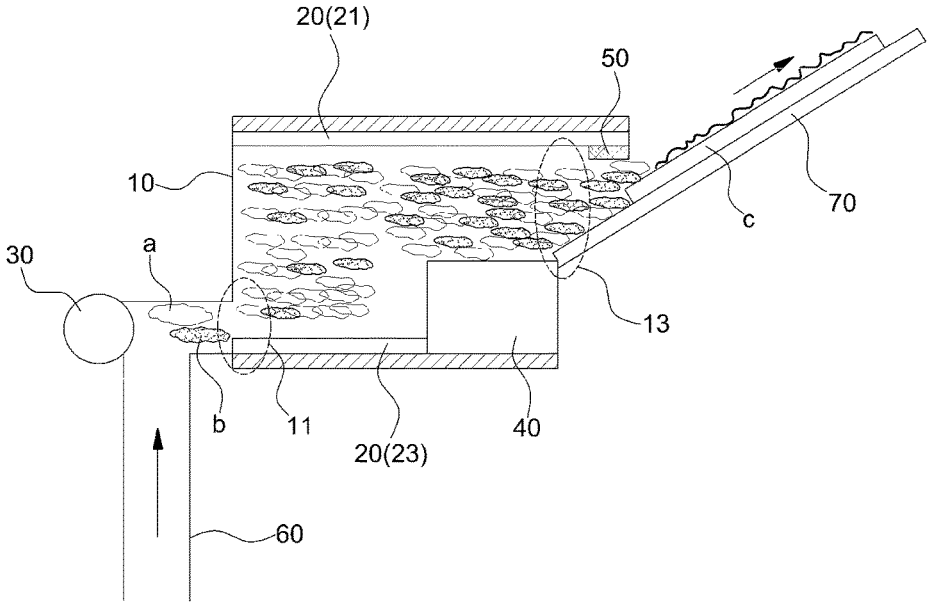
FIG. 2 illustrates a fiber blending chamber according to the present disclosure.

Referring to FIGS. 1 and 2, a PET-kapok fiber blending apparatus (hereinafter, referred to as "fiber blending apparatus") using static electricity may include a fiber blending chamber 10, a discharge plate 20, a blower 30, a nonwoven fabric guard 40, and a feeder 50.

The fiber blending chamber 10 as a component that provides a space in which a PET fiber a and a kapok fiber b are blended may have a predetermined shape, but may have a cylindrical shape in which a cross section is quadrangular, and circular. Referring to FIG. 2, the fiber blending chamber 10 may include an inlet 11 and an outlet 13.

The inlet 11 is formed to penetrate one side of the fiber blending chamber 10. The inlet 11 may be connected with a conveyance tube 60 to be described below. The PET fiber a and the kapok fiber b are introduced into the fiber blending chamber 10 via the inlet 11 by passing through the conveyance tube 60.

The outlet 13 is formed to penetrate the other side of the fiber blending chamber 10. The outlet 13 may be connected with a conveyance device 70 to be described below. A nonwoven fabric c prepared by blending and stacking the PET fiber a and the kapok fiber b is discharged to the outside through the outlet 13 in the fiber blending chamber 10.

The discharge plate 20 is a component that is positioned on the top and the bottom of the fiber blending chamber 10 to accumulate the static electricity. Hereinafter, the discharge plate 20 positioned on the top of the fiber blending chamber is referred to as an upper discharge plate 21 and the discharge plate 20 positioned on the bottom is referred to as a lower discharge plate 23.

The discharge plate 20 may be formed to cover the entirety of an inner surface of the fiber blending chamber 10, but when efficiency and cost efficiency are considered, the upper discharge plate 21 and the lower discharge plate 23 may be divided.

The discharge plate 20 charges the PET fiber a and the kapok fiber b with an electric charge such as the discharge plate 20, as will be further described below.

The blower 30 is a component that blows air creating wind in the inlet 11. Therefore, the PET fiber a and the kapok fiber b may move from the inlet 11 to the outlet 13 in the fiber blending chamber 10.

The PET fiber a and the kapok fiber b need to contact the discharge plate 20 so as for the fiber blending apparatus to effectively operate. Therefore, the PET fiber a and the kapok fiber b need to move vertically in the fiber blending chamber 10.

Figure 3:
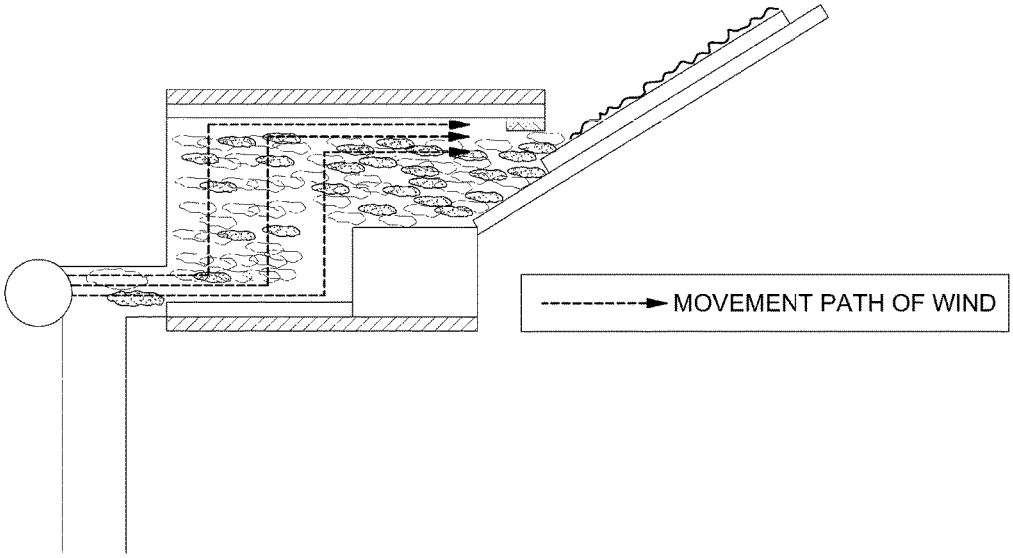
FIG. 3 illustrates a movement path of the wind in the fiber blending chamber according to the present disclosure.

In the fiber blending chamber 10, the movement of the PET fiber a and the kapok fiber b significantly depends on the wind that is generated from the blower 30. Accordingly, a movement path of the wind in the fiber blending chamber 10 is important. Therefore, as illustrated in FIG. 3, the inlet is formed at a lower side of the fiber blending chamber, and as a result, the wind may move from the lower side to an upper side of the fiber blending chamber.

The nonwoven fabric guard 40 may be positioned around the outlet 13. The nonwoven fabric guard 40 may have a projected sill shape formed in the fiber blending chamber 10. Therefore, the nonwoven guard 40 may serve as a kind of sill with respect to the PET fiber a and the kapok fiber b. The PET fiber a and the kapok fiber b meet the nonwoven fabric guard 40 and is stacked on the nonwoven fabric guard 40 while moving from the inlet 11 to the outlet 13, which is described in greater detail below.

The feeder 50 is positioned around the outlet 13 and may be formed to contact the outlet 13. The feeder 50 may have the projected sill shape formed in the fiber blending chamber 10. When the PET fiber a and the kapok fiber b are stacked, the nonwoven fabric c is formed and the nonwoven fabric c contacts the feeder 50 before being discharged to the outlet 13. An area of the outlet 13 becomes narrow as large as the feeder 50 blocks the outlet 13. Therefore, the thickness of the nonwoven fabric c may be controlled by controlling the size of the feeder 50.

Figure 4:
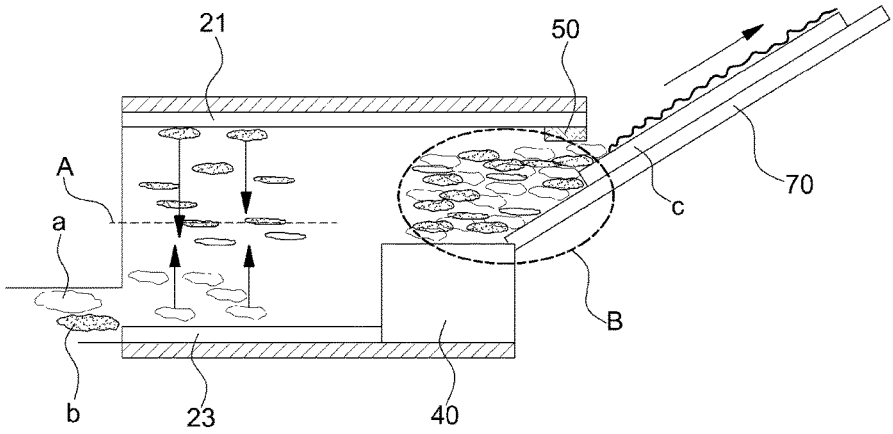
FIG. 4 is a diagram for describing an operating process of the fiber blending apparatus according to the present disclosure.

Hereinafter, a detailed operating process of the fiber blending apparatus will be described with reference to FIG. 4.

The PET fiber and the kapok fiber enter the fiber blending chamber by passing through the inlet through the conveyance tube. Thereafter, the PET fiber and the kapok fiber are blended while moving to the outlet and discharged from the fiber blending chamber by passing through the outlet through the conveyance device.

1) Fiber Blending Process

The PET fiber a and the kapok fiber b that enter the fiber blending chamber through the inlet contacts the upper discharge plate 21 or the lower discharge plate 23 while moving vertically along the movement path of the wind of FIG. 3.

Since the discharge plates 21 and 23 accumulate the static electricity, the discharge plates 21 and 23 have a (+) or (−) charge. Therefore, the PET fiber a and the kapok fiber b that contact the discharge plates 21 and 23 are charged with the same type of charges such as the discharge plates 21 and 23.

Since the same type of charges have a property to push each other, the PET fiber a and the kapok fiber b are pushed from the discharge plates 21 and 23. Such a process is continuously repeated and the PET fiber a and the kapok fiber b are uniformly blended around a center line A passing through the center of a cross section of the fiber blending chamber.

2) Stacking Process

The PET fiber a and the kapok fiber b are blended to gradually move toward the outlet. When the PET fiber a and the kapok fiber b reach the outlet, they are blocked by the nonwoven fabric guard 40. Therefore, a movement speed rapidly decreases and the PET fiber a and the kapok fiber b are neatly stacked in a stacking space B made by the nonwoven fabric guard 40. When the PET fiber a and the kapok fiber b are continuously stacked, the nonwoven fabric c is prepared.

The nonwoven fabric guard 40 may be positioned at the lower side of the fiber blending chamber so that the PET fiber a and the kapok fiber b are more easily stacked.

3) Discharging Process

The nonwoven fabric c of the stacking space B is discharged to the outside of the fiber blending chamber by the conveyance device 70 connected with the outlet. The conveyance device 70 may be a conveyor belt.

In this case, the thickness of the nonwoven fabric c may be controlled by using the feeder 50 that blocks a predetermined area of the outlet. When the size of the feeder 50 is changed, the area of the outlet is controlled, and as a result, nonwoven fabrics c having various thicknesses may be prepared.

Hereinafter, referring to FIGS. 1 and 2, another configuration of the fiber blending apparatus will be described.

The fiber blending apparatus may further include a protection cover 80, a static electricity generator (not illustrated), and a controller 90.

The protection cover 80 is a component that interrupts the conveyance device 70 from the outside. Therefore, contamination of the nonwoven fabric may be prevented.

The static electricity generator (not illustrated) is a component that accumulates the static electricity in the discharge plate. Any such component which may perform such a function may be used while remaining within the scope of the present disclosure.

The controller 90 is a component that controls operations of the conveyance device 70, the static electricity generator (not illustrated), the blower 30, and the like.

Figure 5:
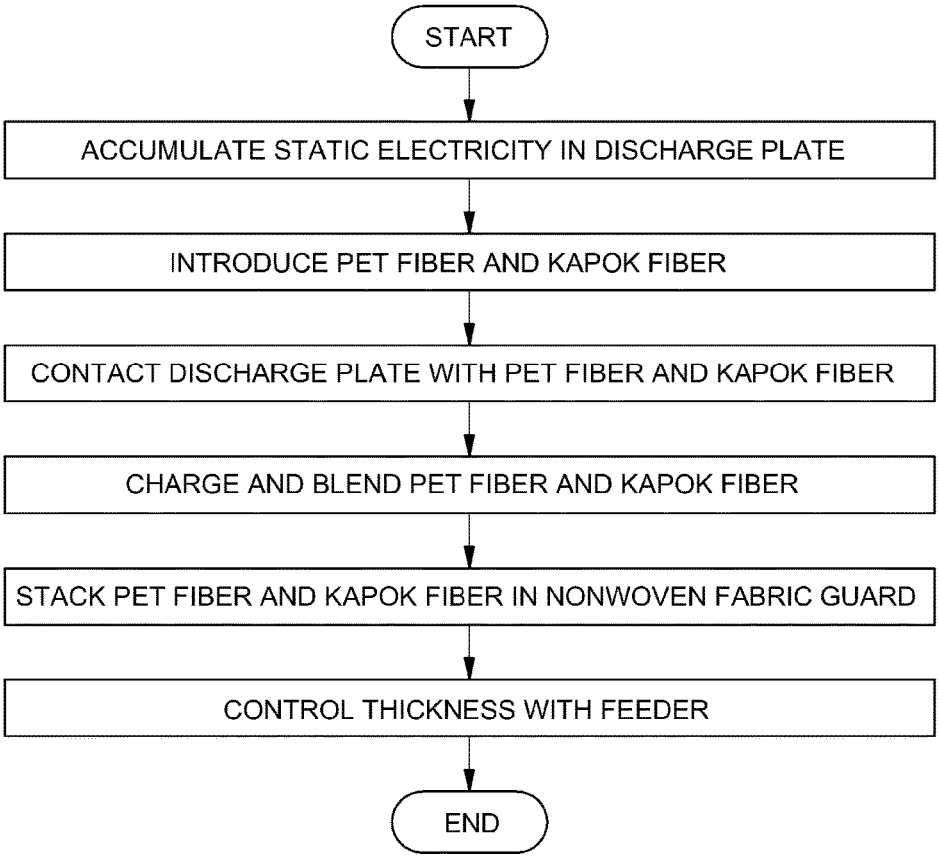
FIG. 5 is a flowchart for describing a fiber blending method according to the present disclosure.

Hereinafter, a fiber blending method using the fiber blending apparatus will be described with reference to FIG. 5.

The fiber blending method according to the present disclosure may include the following steps.

Figure 6:
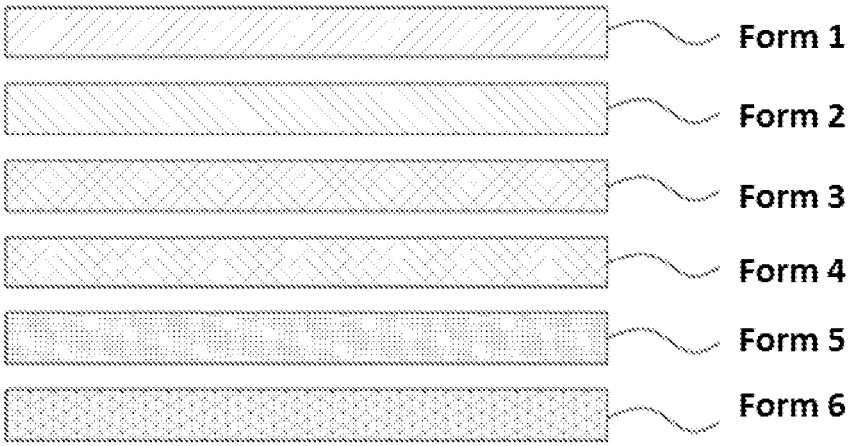
FIG. 6 illustrates a nonwoven fabric prepared by the fiber blending apparatus and the fiber blending method according to the present disclosure.

1) a step of accumulating the static electricity in the discharge plate of the fiber blending chamber by using the static electricity generator 2) a step of introducing the PET fiber and the kapok fiber in the inlet of the fiber blending chamber through the conveyance tube 3) a step in which the PET fiber and the kapok fiber contact the discharge plate while moving vertically along the movement path of the wind generated from the blower 4) a step in which the PET fiber and the kapok fiber are charged with the charge such as the discharge plate to be pushed from the discharge plate and blended around the center line 5) a step in which the PET fiber and the kapok fiber are stacked in the stacking space of the nonwoven fabric guard positioned around the outlet of the fiber blending chamber to become the nonwoven fabric 6) a step of controlling the thickness of the nonwoven fabric by the feeder positioned around the outlet FIG. 6 illustrates a nonwoven fabric prepared by the fiber blending apparatus and the fiber blending method. A composition and the thickness of each nonwoven fabric are listed in Table 1 given below.

TABLE 1

| Items | Composition | Thickness |
|---|---|---|
| Form 1 | PET fiber 100 wt % | 5T |
| Form 2 | PET fiber 90 wt % + kapok fiber 10 wt % | 5T |
| Form 3 | PET fiber 80 wt % + kapok fiber 20 wt % | 5T |
| Form 4 | PET fiber 100 wt % | 10T |
| Form 5 | PET fiber 90 wt % + kapok fiber 10 wt % | 10T |
| Form 6 | PET fiber 80 wt % + kapok fiber 20 wt % | 10T |

Figure 7:
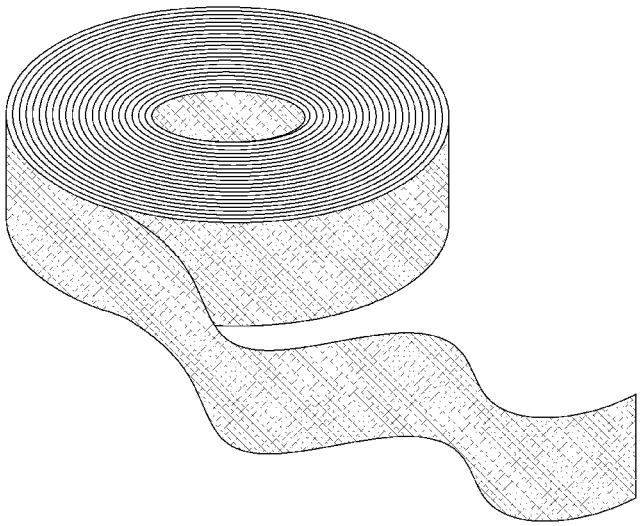
FIG. 7 illustrates a nonwoven fabric prepared by the fiber blending apparatus and the fiber blending method according to the present disclosure, which undergoes a winding process.

FIG. 7 illustrates a nonwoven fabric prepared by the fiber blending apparatus and the fiber blending method and undergoes a winding process. The PET fiber of 90 wt % and the kapok fiber of 10 wt % are blended to prepare the nonwoven fabric with a thickness of 5 T.

The disclosure has been described in detail with reference to various forms thereof. However, it will be appreciated by those skilled in the art that changes may be made in these forms without departing from the principles and spirit of the disclosure, the scope of which is defined in the appended claims and their equivalents.

What is claimed is:

1. An apparatus for blending a polyethylene terephthalate fiber and a kapok fiber, the apparatus comprising:

a fiber blending chamber including an inlet in which the polyethylene terephthalate fiber and the kapok fiber are introduced and an outlet from which a nonwoven fabric is discharged;

a discharge plate positioned at an upper side and a lower side based on a center line passing through the center of a cross section of the fiber blending chamber to accumulate static electricity; and a blower positioned around the inlet and moving the polyethylene terephthalate fiber and the kapok fiber to the outlet in the fiber blending chamber, wherein the polyethylene terephthalate fiber and the kapok fiber contacting the discharge plate are charged with the same charge as the discharge plate to be pushed from the discharge plate and blended around the center line and stacked around an outlet to become the nonwoven fabric and wherein the inlet is formed at the lower side of the fiber blending chamber to move the wind generated by the blower from the lower side to the upper side of the fiber blending chamber.

2. The apparatus of claim 1, further comprising:

a nonwoven fabric guard positioned around the outlet and providing a space in which the polyethylene terephthalate fiber and the kapok fiber are stacked.

3. The apparatus of claim 2, further comprising:

a feeder positioned around the outlet and controlling the thickness of the nonwoven fabric.

4. The apparatus of claim 3, wherein the nonwoven fabric guard is positioned at a lower side of the fiber blending chamber, and the feeder is positioned at an upper side of the fiber blending chamber.

5. The apparatus of claim 1, further comprising:

a conveyance tube connected with the inlet to become a movement path of the polyethylene terephthalate fiber and the kapok fiber; and a conveyance device connected with the outlet to discharge the nonwoven fabric to the outside of the fiber blending chamber.

6. The apparatus of claim 5, further comprising:

a protection cover interrupting the conveyance device from an outside environment.

7. A method for blending a polyethylene terephthalate fiber and a kapok fiber, the method comprising:

1) a step of accumulating static electricity in discharge plates positioned at upper and lower sides of a fiber blending chamber;

2) a step of introducing the polyethylene terephthalate fiber and the kapok fiber in an inlet of the fiber blending chamber;

3) a step of the polyethylene terephthalate fiber and the kapok fiber contacting the discharge plates; and 4) a step in which the polyethylene terephthalate fiber and the kapok fiber are charged with the same charge as the discharge plate to be pushed from the discharge plate and blended;

wherein the fiber blending chamber comprises a blower positioned around the inlet and moving the polyethylene terephthalate fiber and the kapok fiber to an outlet in the fiber blending chamber and wherein the inlet is formed at the lower side of the fiber blending chamber to move the wind generated by the blower from the lower side to the upper side of the fiber blending chamber.

8. The method of claim 7, further comprising:

after step 4), 5) a step in which the polyethylene terephthalate fiber and the kapok fiber are stacked in a nonwoven fabric guard positioned around an outlet of the fiber blending chamber to become the nonwoven fabric.

9. The method of claim 8, further comprising:

after step 5), 6) a step of controlling the thickness of the nonwoven fabric by a feeder positioned around the outlet.

* * * * *